United States Patent [19]

Pettengill et al.

[11] Patent Number: 5,038,963

[45] Date of Patent: Aug. 13, 1991

[54] MULTI-CAVITY DISPENSING CONTAINER

[75] Inventors: Edwin R. Pettengill, Stratford; James L. Gentile, Orange, both of Conn.

[73] Assignee: Chesebrough-Pond's, Inc., Greenwich, Conn.

[21] Appl. No.: 515,597

[22] Filed: Apr. 30, 1990

Related U.S. Application Data

[63] Continuation-in-part of Ser. No. 324,588, Mar. 16, 1989.

[51] Int. Cl.[5] ..... B67D 5/60

[52] U.S. Cl. ..... 222/145; 222/137; 222/364

[58] Field of Search ..... 222/137, 145, 564, 94, 222/330; 239/306, 418

[56] References Cited

U.S. PATENT DOCUMENTS

| | | | |
|---|---|---|---|
| 3,166,221 | 1/1965 | Nielsen et al. | 222/137 |
| 4,487,757 | 12/1984 | Riozpeoplou | 424/7.1 |
| 4,687,663 | 8/1987 | Schaeffer | 222/94 |
| 4,742,940 | 5/1988 | Wilkinson | 222/162 |
| 4,747,517 | 5/1988 | Hart | 222/137 |
| 4,964,539 | 10/1990 | Mueller | 222/94 |
| 4,974,756 | 12/1990 | Pearson et al. | 222/145 |

*Primary Examiner*—Michael S. Huppert
*Assistant Examiner*—Shari M. Wunsch
*Attorney, Agent, or Firm*—Brumbaugh, Graves, Donohue & Raymond

[57] ABSTRACT

A rigid piston-type multi-cavity dispensing container for simultaneous coextrusion of two or more flowable materials in a predetermined proportion, such as multi-component toothpaste and the like which, upon relative compression of the upper and lower body members, produces a single, banded, unmixed stream of material. The container has a unique outlet assembly which is arranged to cause the outlet streams of material to flow towards each other. The outlet assembly maintains the segregation of the different materials as they move simultaneously outward through the outlet.

3 Claims, 6 Drawing Sheets

MULTI-CAVITY DISPENSING CONTAINER

BACKGROUND OF THE INVENTION

This application is a continuation in part of U.S. application Ser. No. 324,588, filed Mar. 16, 1989.

1. Field of the Invention

The present invention relates to a rigid telescopically arranged multi-cavity dispensing container for a flowable material, such as toothpaste and the like, from which it is desired to dispense simultaneously two or more reactive substances which require separate storage until time of use.

2. Prior Art

There exists a desire to provide sodium bicarbonate and peroxide gel as components of toothpaste. Sodium bicarbonate is a well known and commonly used abrasive and cleaner. Peroxide gel is regarded as a beneficial ingredient to help promote healthy gums. These components are reactive when mixed, and therefore must be maintained separately until time of use.

Wilkinson U.S. Pat. No. 4,742,940 discloses a basic single cavity dispenser. A hollow upper cylinder filled with a single flowable material has a dispensing spout but is otherwise closed at its upper end. A piston is arranged for telescopic upward movement within the upper cylinder so as to force a stream of flowable material through the spout upon relative compression of the piston and cylinder.

Hart U.S. Pat. No. 4,747,517 discloses a single cavity container for simultaneously dispensing increments of two extrudable materials that polymerize when mixed. The two materials are separated by an extrudable barrier layer which prevents intermixing of the materials until after they emerge from the outlet. A piston slidably mounted within the cavity acts to force the materials through a specially-adapted mixing nozzle so that the materials emerge in an already-mixed state. The nozzle must then be removed and replaced after each use because of the trapped epoxy mixture which later hardens and clogs the passageway.

Neilsen U.S. Pat. No. 3,166,221 discloses a rigid piston-type, double-tube dispensing container with a rigid barrier separating the two compartments. When the tube member is pushed down into the housing member, the contents will be pressed out through two separate nozzles. The contents emerge in the shape of two separate but closely juxtaposed bands which are difficult to dispense neatly onto the narrow width of a toothbrush.

Schaeffer U.S. Pat. No. 4,687,663 discloses various configurations for simultaneously dispensing hydrogen peroxide and sodium bicarbonate. A rigid pump-type dual-cavity dispenser has two closely-positioned but separate outlets producing a double material stream which is difficult to apply to the narrow width of a toothbrush surface. Also disclosed is a collapsible tube separated into two compartments by a divider which extends to the rim of the mouth. Such an embodiment fails to take into account the possibility that the two components might have different rheologies, which will result in improperly proportioned quantities of the two materials being dispensed when the tube is squeezed.

U.S. Pat. No. 4,487,757 also discloses a toothpaste tube with separate compartments with a divider extending to the dispensing nozzle. Experimentation has shown that embodiments of this patent and the Schaffer patent tend to dispense the dual materials in an uncontrolled manner, for example, there is a tendency to dispense the dual material in uncontrolled varying proportions. Dispensing of the dual materials in predetermined proportions becomes even more difficult if the materials are of different rheologies. In addition, in certain embodiments there is a tendency of the materials to curl away from each other as they emerge from the nozzle, making it difficult to provide efficient dispensing onto a toothbrush.

It is thus an object of the present invention to provide a rigid piston-type multi-cavity dispensing container for simultaneous coextrusion in predetermined proportions of two or more flowable materials, which may have different rheologies, such as two components of a toothpaste and the like which, upon relative compression of the upper and lower body members, produces a single, banded, unmixed stream of material that can be neatly and easily applied onto the narrow width of a toothbrush.

It is a further object to provide such a dispenser which dispenses a single stream of unmixed material and which provides segregation of the component materials within the dispenser both prior to and after dispensing.

SUMMARY OF THE INVENTION

In accordance with the present invention there is provided a multi-cavity dispensing container for the simultaneous coextrusion of at least two flowable materials. The container includes at least two hollow and separate parallel cylinders having a first generally closed end and a second end which telescopically and slidingly accommodates a corresponding number of parallel pistons which conform to ride sealingly along the interior walls of the cylinders to force the flowable materials toward the first end of the cylinders upon relative compression of the cylinders and pistons. The cylinders are provided with outlet channels communicating with an outlet means having adjacent outlet openings and means for causing the flowable materials to flow towards each other at the outlet openings to form a single, banded, unmixed stream of the materials.

In a preferred arrangement the outlet means includes a tapered septum dividing the outlet means. A hinged cap having conforming recesses for receiving the outlet end of the outlet means and the septum may be provided. The cylinders and pistons may be provided with conforming shrouds for guiding relative motion of the cylinders and pistons.

For a better understanding of the present invention together with other and further objects, reference is made to the following description, taken in conjunction with the accompanying drawings, and its scope will be pointed out in the appended claims.

DETAILED DESCRIPTION

Figure 1:
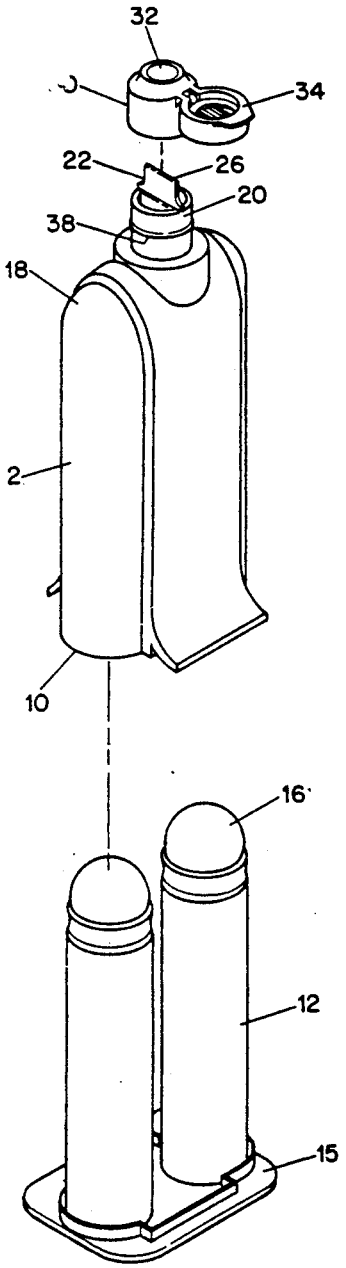
FIG. 1 is an exploded projection view of a syringe-type dual-cavity embodiment of the invention.
Figure 3:
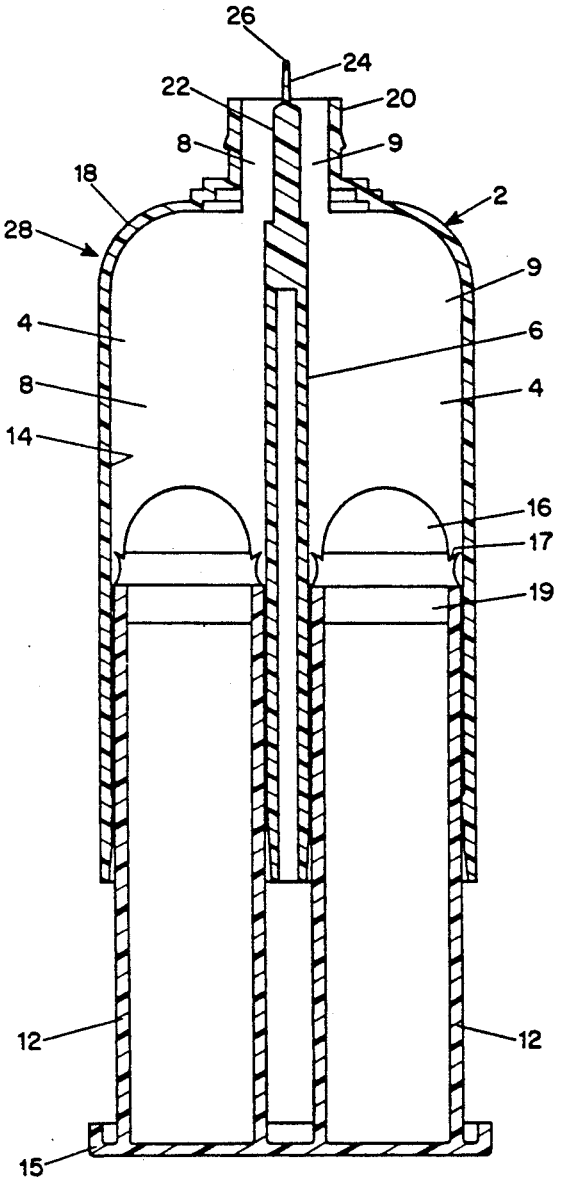
FIG. 3 is a frontal cross-sectional view of the embodiment of FIG. 1.
Figure 4:
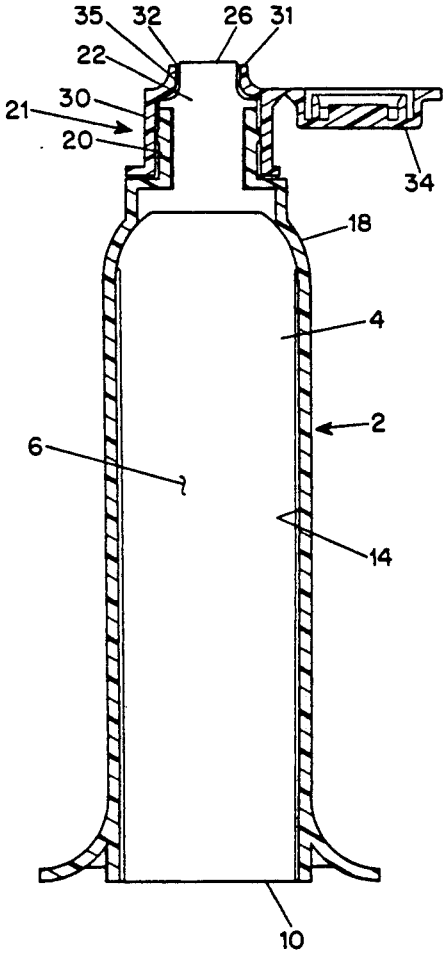
FIG. 4 is a side cross-sectional view of the sleeve portion of the embodiment of FIG. 1.

One embodiment of a device according to the invention will first be described as a "syringe version" for dispensing two materials, with reference to FIGS. 1, 3 and 4. A rigid sleeve 2 has two parallel hollow cylinders 4 separated by a rigid barrier 6. The two cylinders 4 each contain one of two reactive flowable materials 8, 9. The sleeve 2 is open at its bottom 10 to telescopically and slidingly accommodate a pair of parallel pistons 12 which conform to ride sealingly within the inner walls 14 of the cylinders 4. The pistons 12 are fixed to a multifunction base 15 which provides leverage for hand dispensing and which permits the device to stand upright when not in use. Furthermore, the base rigidly retains the pistons so as to provide for the smooth, equal and simultaneous movement of the two pistons into the cylinders during operation. The piston heads 16 should substantially conform to the shape of the upper closed portion 18 of the sleeve 2 so as to efficiently dispense the entire contents 8, 9 of the package. To accomplish this, the heads 16 may be of a hemispherical or other rounded shape. In the embodiment illustrated, the piston heads 16 are fabricated of a pliable material and include sealing rings 17 which press against the cylinder walls to provide a seal. A lower cylindrical extension 19 of the piston head 16 is received into the hollow end of each piston 12 and has a locking lip to retain it fixedly therein.

The closed upper end 18 of the sleeve 2 has a cylindrical dispensing outlet passage 20 located diametrically above the barrier 6. The outlet passage 20 has two passageways, each of which connects to one of the two hollow cylinders 4 containing the materials 8, 9. Upon relative compression of the sleeve 2 and piston portion 12, the materials 8, 9 will flow into the respective passageways of outlet passage 20. The outlet passage 20 is arranged to receive a separate nozzle 30, which together comprise the outlet means 21.

The outlet passage 20 is bisected by a flat rigid septum 22 extending from the barrier 6 and sitting fixedly within the inner walls of the outlet passage 20. The septum 22 is tapered 24 cross-sectionally and ends in a straight edge 26. The cross-section of the septum edge 26 is a sharp angle approximated by a very small radius. The sides of the septum are preferably textured, for example by vapor honing, to a dull finish to promote adherence of the products thereto, which together with the taper 24 causes the product streams to converge into a single stream at the outlet opening 32 of nozzle 30.

The septum 22 of this unique nozzle design acts to keep the two reactive materials 8, 9 separate as they emerge from the cylinders 4 and also prevents reaction and obstruction of the outlet means 21 by reaction products. The materials 8, 9 converge as they flow through the outlet means 21 but the two streams do not meet until they have fully left the outlet means opening 32. The taper design of the septum 22 causes the two streams 8, 9 to gradually converge until they meet at the septum edge 26 beyond the end of the outlet means opening 32. At this point, they smoothly touch and continue to flow onto the intended surface, e.g. toothbrush, as a single, substantially cylindrical, two-banded stream. This single stream is convenient and easy to direct with accuracy upon a limited surface area.

The diameter of the emerging single stream may be regulated according to packaging specifications. For example, nozzle 30 which snaps on around the outlet passage 20 by engaging ridge 38 may be provided. Nozzle 30 has an interior taper which reduces the effective outlet passage diameter as shown in FIG. 4. In such an embodiment, the length of the septum edge 26 is reduced and the side edges of the septum conform to the converging inner shape 35 of the nozzle 30.

Figure 13:
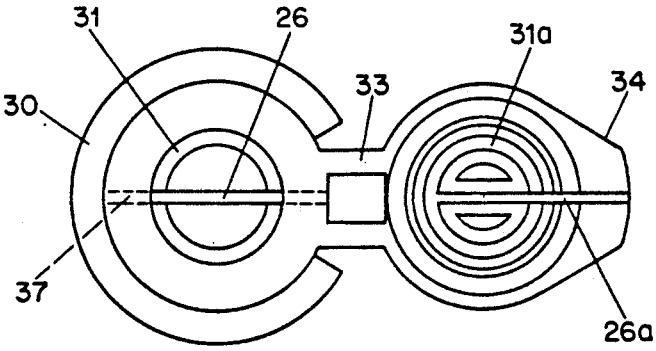
FIG. 13 is a top view of a cap and nozzle arrangement for a dual-cavity embodiment of the invention.
Figure 14:
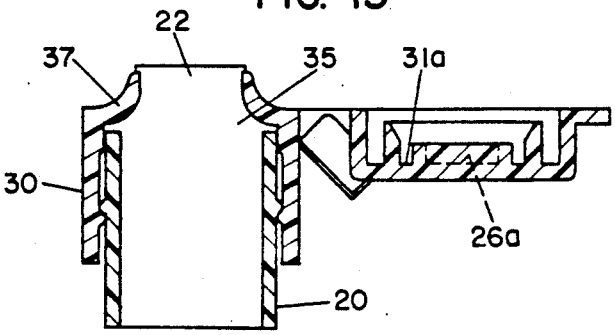
FIG. 14 is a side cross-sectional view of the nozzle arrangement of FIG. 13.

With reference to FIGS. 13 and 14, nozzle 30 is provided with longitudinal grooves 37 along its converging inner wall for retaining the inward sloping sides of the septum 22 residing therein. Such an arrangement maintains the septum 22 in a rigid position within the outlet means 21 and prevents intermixing of the streams at contact points of the assembled septum 22 and outlet means 21. The septum 22 extends to a location preferably 0.005 to 0.010 inches beyond the outlet means opening 32.

The nozzle 30 preferably has a cap 34 connected thereto by a hinge 33. Cap 34 includes a complementary engaging means comprising recesses 31*a* and 26*a* for receiving respectively nozzle rim 31 and septum edge 26 during closure, so that intermixing of the two substances 8, 9 is prevented once the cap is closed.

As an important aspect of the present invention, the outlet means 21 is provided with one or more means for causing the outlet streams to flow toward each other and avoid the otherwise uncontrolled outlet flow which can result in the streams of the two or more materials flowing away from each other as they emerge from the outlet opening. The means may include a tapered septum 22 which divides the outlet, tapered peripheral walls on the outlet means as exemplified by nozzle 30, shown in FIGS. 4 and 14, or a differential surface resistance on the interior walls of the outlet means, such that greater surface resistance is provided on the interior surfaces which are adjacent to other outlet openings than on the peripheral interior surfaces of the outlet means. Thus, in the embodiment of FIG. 4, the surfaces of septum 22 may be provided with a dull finish, such as by vapor honing, while the interior peripheral surfaces of nozzle 30 remain smooth. As the materials flow over the surfaces there will be greater resistance to the flow over the septum causing the flow of materials to "curl"

in the direction of the septum as they emerge from the outlet, whereby the two or more streams of materials curl towards each other and converge into a single stream. Alternately, the interior peripheral surfaces of the outlet means can be treated, e.g. with a lubricant, such as polytetrafluoroethylene or silicone materials to reduce the surface friction of the interior peripheral surfaces as compared to the surface friction of the septum 22.

Figure 2:
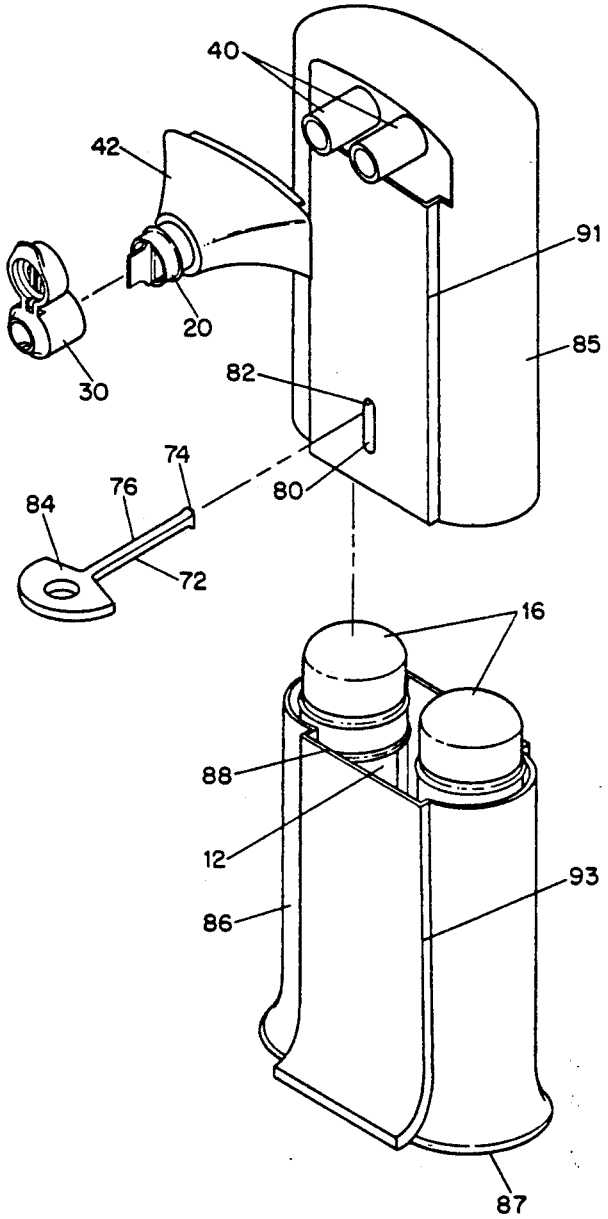
FIG. 2 is an exploded projection view of a pump-type dual-cavity embodiment of the invention.

Another embodiment of the device, the pump version, shown in FIG. 2 in a dual-cavity arrangement, includes upper shroud 85 and lower shroud 86 telescopically engagable for relative compression by a single force exerted down on the top against the ground surface supporting an anti-rocking base 87. Upper shroud 85 includes two cylinders, similar to those of the FIGS. 1 and 3 embodiment, except that the outlet passages connected to the closed upper end of the cylinders are brought out sideways to connect to tubes 40. Upper shroud 85 includes a longitudinal projecting ridge 91. Lower shroud 86 surrounds a pair of cylindrical pistons 12 having piston heads 16. Cylinders 12 are connected to shroud 86 by base 87, which is enlarged to provide greater stability for the assembly. Shroud 86 is provided with a ridge 93 and is dimensioned to receive upper shroud 85 so that shroud 85 is received between pistons 12 and shroud 86 when pistons 12 are inserted within the cylinders of upper shroud 85. As the two portions are assembled, ridges 91 and 93 serve to guide the motion of the two portions, providing smooth linear motion even where the materials in the two cylinders have different rheologies.

Figure 5:
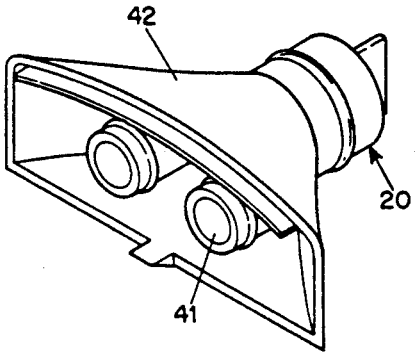
FIG. 5 is a projection view of the nozzle housing of the embodiment of FIG. 2.
Figure 6:
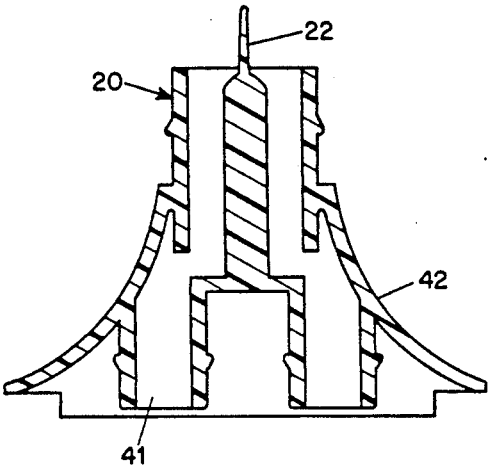
FIG. 6 is a lengthwise cross-sectional view of the FIG. 5 nozzle housing.

This "pump version" also has an outlet assembly 42, shown in FIGS. 5 and 6, which provides for a forward facing dispensing nozzle. Two hollow cylinders within upper sleeve 85 have outlet passages that extend into two separate forward facing tubes 40 of reduced diameter. An outlet assembly 42 is fitted about the tubes 40 and converges so as to end in an outlet passage 20 with two passageways as described above. The tubes 40 receive tube sleeves 41 of the outlet assembly 42. As the tube sleeves 41 converge within the outlet assembly 42, they form a common rigid barrier which extends through the outlet means 21 as a septum 22, described above. A nozzle 30 may also be provided as described above to additionally comprise the outlet means 21.

The shrouds 85, 86 of the pump version may possess guide means 91, 93 on either of two opposing sides comprising conforming, longitudinal, outward, rectangular extensions of the shrouds 85, 86, one of which guide means 91, 93 rides within the other during relative compression of the sleeves. The guide means prevent rocking of one sleeve within another and consequent uneven relative motion of the two pistons. Therefore, materials 8, 9 of differing rheologies may be dispensed in a predetermined proportions. It is understood that the guide means may be of any acceptable shape and comprise a plurality of extensions, both inward and outward. In addition to providing guided relative motion of the shrouds, the extensions improve the mechanical rigidity of the shrouds.

Further embodiments of both the syringe and pump versions of the device may employ a reversed piston orientation wherein the upper member includes the pistons and the outlet passages, and the lower member includes the cylinders containing the flowable materials. As relative compression of the upper and lower portions takes place, the materials are forced upward through separate paths formed within the upper member leading to the outlet means.

Figure 12A:
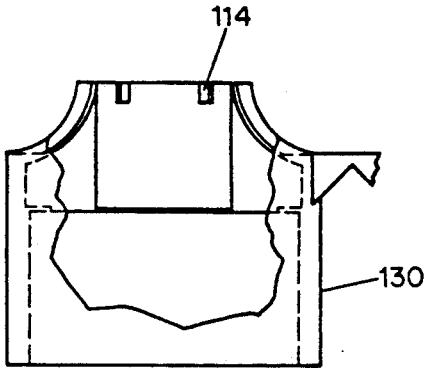
FIG. 12A is a partial cutaway frontal view of a striping nozzle.
Figure 12B:
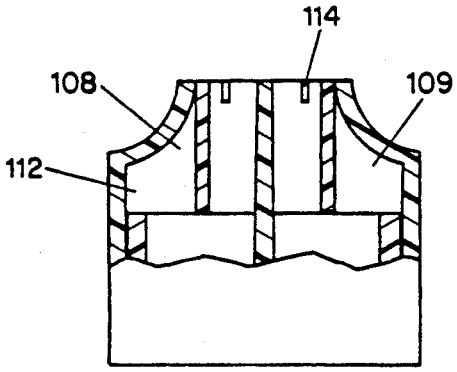
FIG. 12B is a side cross-sectional view of the nozzle of FIG. 12A.
Figure 11:
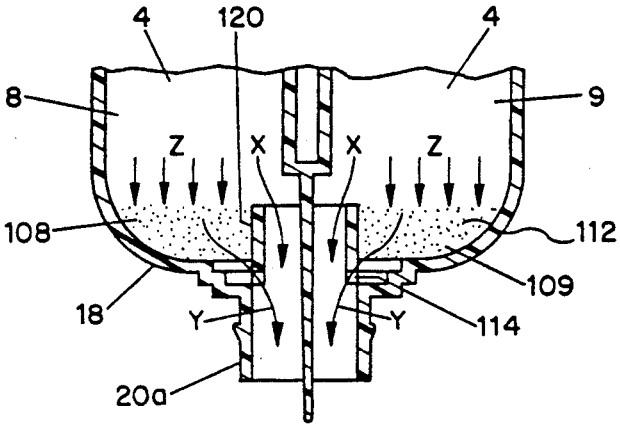
FIG. 11 is a cross-sectional view of a striping mechanism useful with the embodiment of FIG. 1.

Additional embodiments of both versions may also possess a striping feature, whereby, e.g., color or flavor additives, or functional ingredients are imparted to at least one stream as it passes through the outlet means 21. For the syringe version, as shown in FIG. 11, an amount of striping fluid 108, 109 is contained near the upper closed portion 18 of each cylinder 4. A striping fluid retaining region 112 is defined by the upper closed portion 18 of each cylinder 4 and by an extension 120 into each cylinder 4 of the outlet passage 20. As the contents 8, 9 are forced towards the upper closed portion 18 during use, they will pass through the outlet passage 20, as indicated by the arrows "X". The contents 8, 9 will at the same time apply force against the striping fluids 108, 109 as indicated by the arrows "Z". Under this force, the striping fluids 108, 109 will be forced as shown by arrows "Y" through one or more relatively small orifices 114 interconnecting the retaining region 112 and the outlet passage **20*a*. Thus, upon compression of the device, amounts of striping fluid 108, 109 will enter the respective outflowing streams 8, 9. Additionally, the striping feature may be imparted by a striping nozzle, shown in FIGS. 12A and 12B. The striping nozzle 130 is fitted about the outlet passage 20 in similar fashion to the nozzle 30 described above, and operates as does the above-described striping feature. Striping fluids 108, 109 are located in retaining regions 112 within the striping nozzle 130. Amounts of the fluids 108, 109 are picked up by and carried along with the outgoing streams 8, 9 via contact at one or more communicative orifices 114**.

Figure 15:
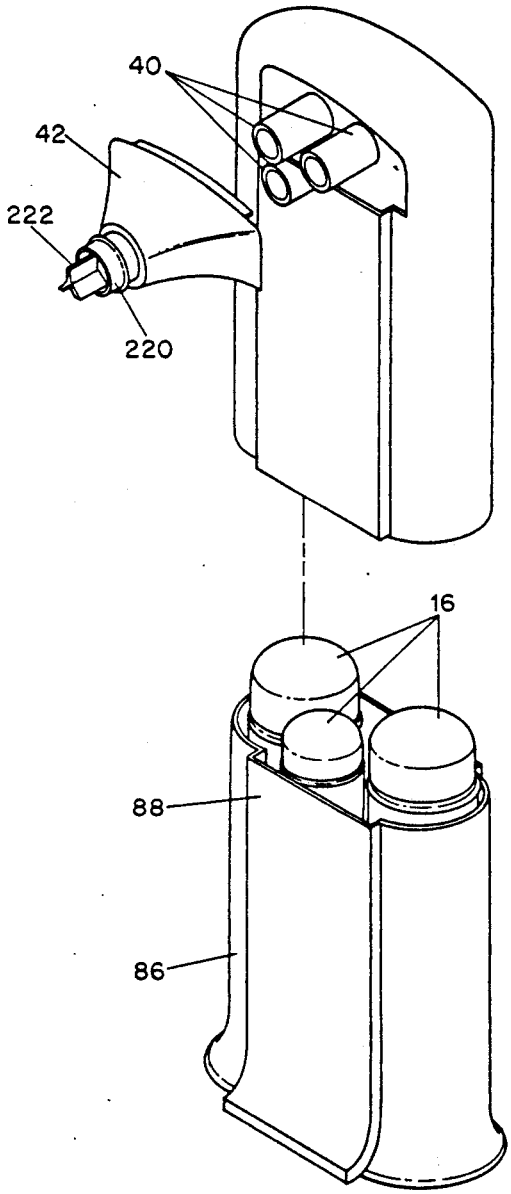
FIG. 15 is an exploded projection view of a pump-type three-cavity embodiment of the invention.

It is easily seen that the device may also be extended to simultaneously dispense more than two materials by providing an increased number of parallel hollow cylinders and corresponding number of pistons. The nozzle may be appropriately subdivided by a septum assembly having septum members extending to the nozzle walls from a central point. FIG. 15 shows a three-cavity dispenser. The outlet passage 220 is divided by the septum assembly 222 which includes three planar septum members dividing the outlet into three separate passages. The above descriptions relating to a recessed cap 34 and recesses on the inner walls of the nozzle 30 may be easily adapted to a tripartite or multipartite septum assembly.

Figure 9:
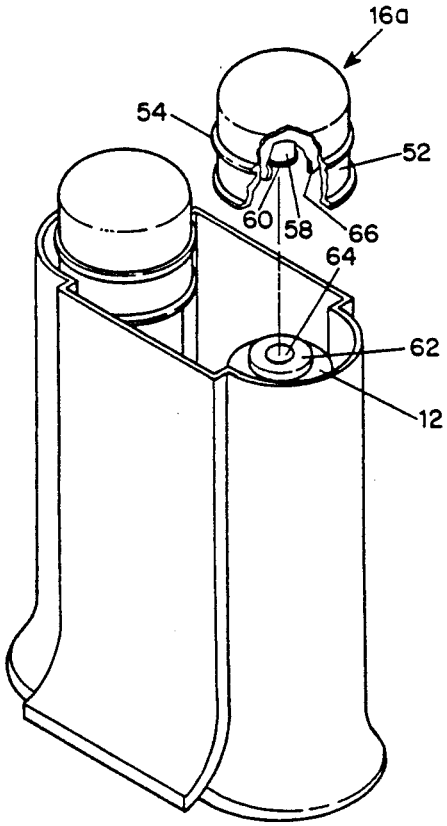
FIG. 9 is a projection view of the base portion of the FIG. 2 embodiment showing the piston head.
Figure 10:
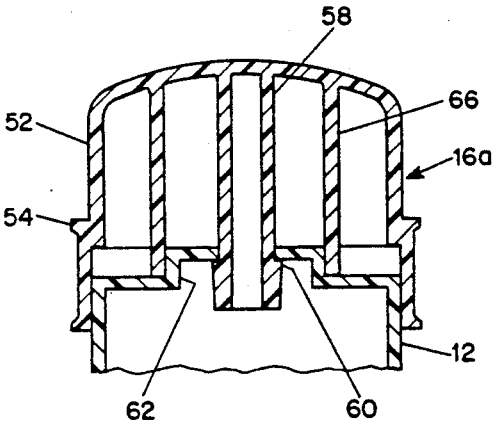
FIG. 10 is a vertical cross-sectional view of the FIG. 9 piston head.

The dispenser may further possess an improved piston head, shown in FIGS. 9 and 10, which is characterized by its simplicity and ease of assembly. The piston head **16*a* has an exterior shell 52 of a flexible material such as soft plastic or the like. The shell has a circumferential wiping surface 54 for bearing against the inner walls 14 of the cylinders 4. A cylindrical plug 58 is mounted within the shell 52, the plug 58 having an enlarged rib 60 which enters bore 64 formed on the end 62 of the piston 12. The cylindrical plug 58 supports the piston head 16*a* against removal from piston 12. An intermediate cylindrical member 66 surrounds projecting piston end 62 and supports piston head 16*a* against the piston end 62. The intermediate cylindrical member 66 acts to push the shell 52 along with the piston 12 when the piston is pushed into the cylinder 4** during operation of the dispenser.

Figure 7:
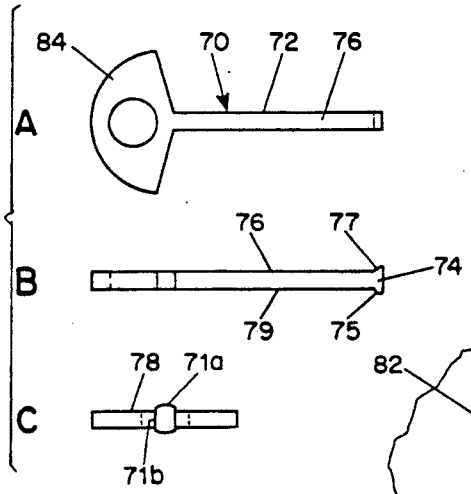
FIGS. 7A, 7B, and 7C are the top, side and frontal views, respectively, of the key used with the FIG. 2 embodiment.
Figure 8:
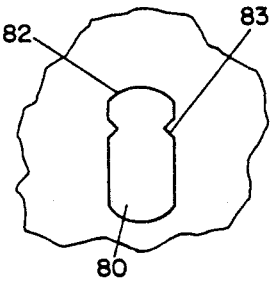
FIG. 8 is a frontal view of the locking mechanism portion of the embodiment of FIG. 2.

An embodiment of the pump version of the device may additionally contain a locking mechanism, shown in FIGS. 7 and 8, which prevents unwanted relative compression of the upper cylinder portion and lower piston portion during shipping and at other times before first use is desired. A key 70, shown in FIGS. 7A, 7B and 7C comprises a rod 72 of rectangular cross-section. The rod may be straight, as shown in FIG. 2, or may at its end 74 have at least one of opposing sides 76, 79 sloping upward 77, 75 to form an enlarged end 78 of partial circular cross-section as shown in FIG. 7. As shown in FIG. 2, before assembly of the device, the key 70 is inserted through at least one longitudinal slot 80, preferably two slots formed in the front and back faces of the upper sleeve 85. When the key has sloping opposing sides, the key 84 is then rotated so that the round sides 71*a* of the end face 78, which are wider apart than the width of the slots 80, prevent it from being pulled outward from the upper sleeve 85. When a straight rod is used, it is dimensioned to snugly fit into slot 80 and be held therein by friction.

When the device is assembled, the upper sleeve 85 is telescopically placed into the rigid lower sleeve 86 which fixedly houses the pistons 12 therein. The rod 72 abuts the upper end 88 of the lower sleeve 86, and is retained above by a stop 82 formed by the end of the slots 80. Slot 80 may include side edge ridges 83 to retain the rod near the stop 82. Thus, further relative movement of the sleeves 85 and 86 is prevented. If the key has sloping opposing sides when first use is desired, the key may be rotated so that the straight sides 71*b* of the end face 78 line up with the edges of the slot. The key 84 is then pulled outward and compression of the device is permitted. Using greater force the key may be removed without rotation. When a straight rod is used the key maybe removed without rotation by simply pulling straight out.

Figure 16:
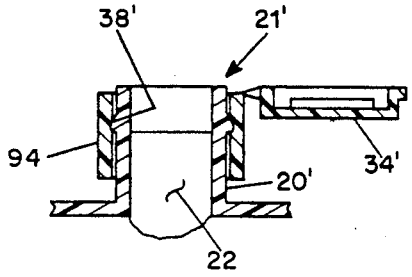
FIG. 16 is a cross-sectional view of an alternate embodiment of the outlet means for a dispenser of the present invention.
Figure 17:
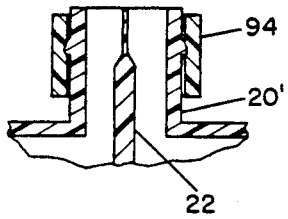
FIG. 17 is a perpendicular cross-section of the FIG. 16 outlet means.

FIGS. 16 and 17 are cross-sectional views showing an alternate outlet arrangement. In the outlet means 21', septum 22 is molded to outlet passage 20' which extends to the septum edge 26. A sleeve 94 surrounds outlet 20' and provides a mounting piece for flip cap 34'. Ridge 38' circumferentially surround outlet passage 20' and retain sleeve 94 in position by a matching circumferential groove. Cap 34' contains the conforming recesses for engaging the outlet openings formed by outlet passage 20' and septum edge 26.

Figure 18:
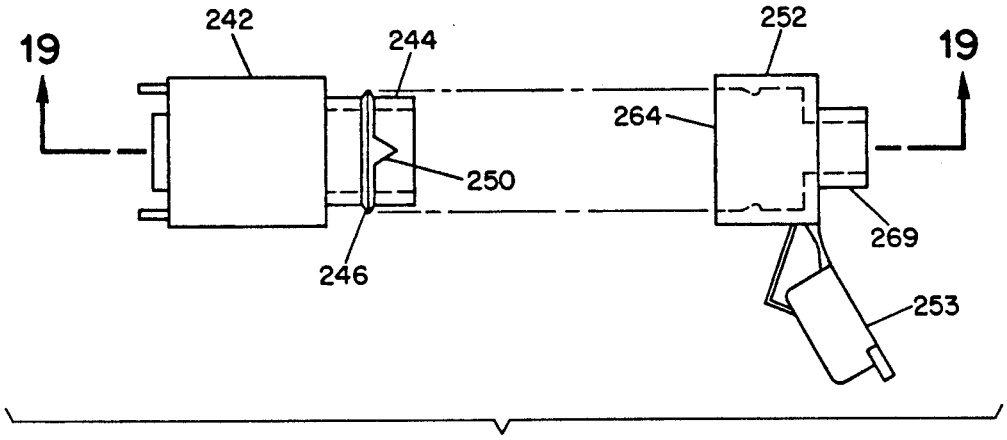
FIG. 18 is a side view of an alternate two piece outlet assembly.
Figure 19:
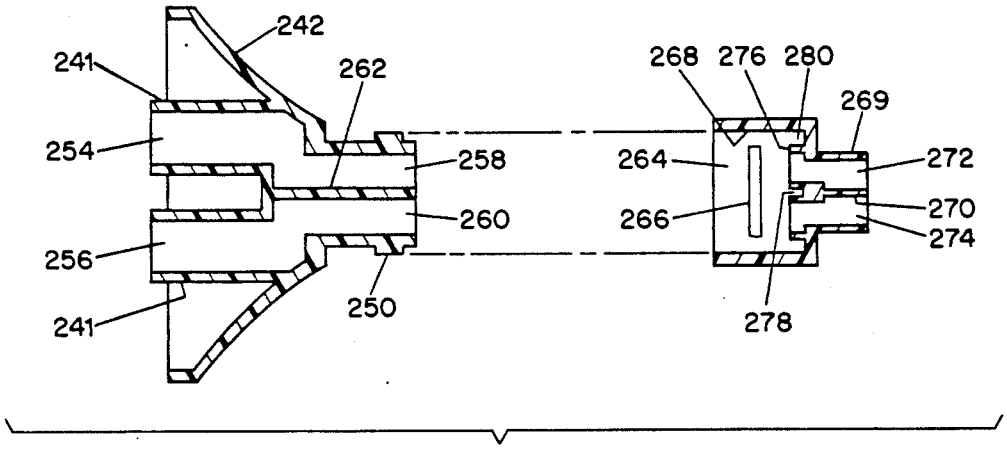
FIG. 19 is a cross-sectional view of the Figure 18 outlet assembly.
Figure 20:
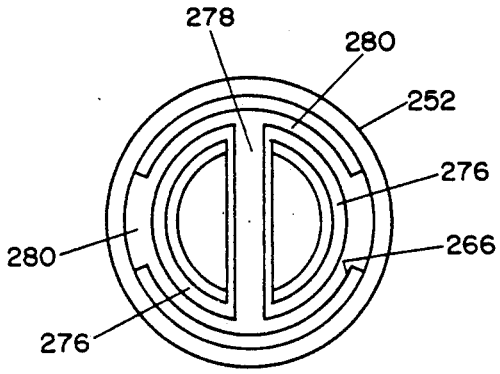
FIG. 20 is an enlarged interior end view of the nozzle member of the outlet of FIG. 18.

An alternate embodiment of outlet assembly 42 is shown in FIGS. 18, 19 and 20. Outlet assembly 42, as shown in FIGS. 5 and 6, includes a projecting thin septum 22, which may pose difficulties in fabrication. In the alternate embodiment of FIGS. 18 through 20 the outlet assembly 42 is fabricated of connecting part 242 and nozzle member 252, and the use of a thin projecting septum is eliminated.

Connecting part 242 includes a housing arrangement similar to that of part 42 which engages projecting outlets 40 of the upper housing member 85, and includes sleeves 241 which have internal passages 254 and 256. A cylindrical extension 244 of connecting part 242 includes an interior septum 262 extending to the forward end thereof and separating internal outlet passages 258 and 260 which are respectively connected to inlet passages 254 and 256.

A separate nozzle member 252 is arranged to snap fit over cylindrical extension 244 of connecting part 242. To facilitate the snap fit in an appropriate rotational orientation, cylindrical extension 244 is provided with an engaging rib 246 and triangular shaped locating protrusions 250. Nozzle member 252 has a recess portion 264 with an interior rib 266, shown in FIG. 19 which is engaged by rib 246. As shown in FIG. 20 interior rib 266 only extends partially around the peripheral nozzle member 252 whereby gaps are formed to receive triangular locating ridge 250 to assure appropriate angular orientation of nozzle member 252 when is fitted over extension 244. Nozzle member 252 includes a nozzle portion 269, which is circular in cross-section and includes septum 270 which bifurcates nozzle 269 into channels 272 and 274. Septum 270 is preferably tapered and textured as described above and extends to the outlet opening of nozzle member 252. The interior ends of channels 272 and 274 within recess 264 include projecting ribs 276 which form grooves 280 and 278 for receiving respectively the edges of the peripheral walls of extension 244 and septum 262. Tapered ridges 268 on the interior wall of recess 264 are arranged to press the peripheral edges of extension 244 of member 242 into close fit with ridges 276. In an exemplary embodiment four such tapered ridges are provided at equal spacing around recess 264.

Nozzle member 252 is provided with a snap fit cap pivotably mounted thereto having a configuration similar to cap 34 illustrated in FIGS. 13 and 14.

When assembled, the peripheral edges of channels 258 and 260 are guided into the proper orientation of grooves 280 and 278 by triangular ridges 250 acting in conjunction with interior ridges 266. When fully inserted ridge 266 snaps behind ridge 240 and the forward edges of extension 244 are pressed close to projections 276 by ribs 268, forming a close fit between outlet passages 258 and 260 of connecting 242 and passages 272 and 274 of nozzle member 252.

While there have been described what are believed to be the preferred embodiment of the present invention, those skilled in the art will recognize that other changes and modifications may be made thereto without departing from the spirit of the invention and it is intended to claim all such changes and modifications as fall within the true scope of the invention.

We claim:

1. In a dispensing container for the co-extrusion of at least two flowable materials, having at least two flowable material reservoirs each having an outlet passage for said materials, an improved outlet assembly, comprising:

a connecting member having at least two inlet passages for providing fluid connection to said reservoir outlet passages and having a cylindrical extension with at least one interior septum forming at least two connecting member outlet passages, said interior septum having an outlet end which is coplanar with the end of said cylindrical extension;

and a nozzle member having a cylindrical recess for receiving said cylindrical extension, said recess including connection means for engaging said extension and guide means for guiding the angular orientation between said nozzle member and said cylindrical extension, said nozzle member further including a nozzle portion having at least two fluid channel separated by at least one septum extending at least to the outlet end of said nozzle portion, and means for providing fluid connection from said connecting member outlet passages to said fluid outlet channels comprising grooves formed at the inner axial end of said recess for receiving said planar end of said cylindrical extension and said interior septum of said cylindrical extension, said grooves being formed by ridges arranged to extend into the ends of said cylindrical extension outlet passages.

2. The improvement specified in claim 1 wherein said septum of said nozzle portion is textured to have a dull finish.

3. The improvement specified in claim 1 wherein said septum of said nozzle portion is tapered to a smaller thickness at said outlet end.

* * * * *